United States Patent [19]

Ebmeyer et al.

[11] Patent Number: 4,936,178

[45] Date of Patent: Jun. 26, 1990

[54] PUNCHING APPARATUS

[75] Inventors: Wilfried Ebmeyer, Enger; Günter Mattiebe, Bielefeld, both of Fed. Rep. of Germany

[73] Assignee: Windmoller & Holscher, Lengerich, Fed. Rep. of Germany

[21] Appl. No.: 248,958

[22] Filed: Sep. 26, 1988

[30] Foreign Application Priority Data

Sep. 25, 1987 [DE] Fed. Rep. of Germany ..... 3732421

[51] Int. Cl.[5] ..... B26F 1/04

[52] U.S. Cl. ..... 83/628; 83/213; 83/543; 83/859; 72/452; 74/57

[58] Field of Search ..... 83/543, 542, 627, 628, 83/859, 213, 214, 746, 202; 72/452; 74/57; 30/392

[56] References Cited

U.S. PATENT DOCUMENTS

| | | | |
|---|---|---|---|
| 1,134,047 | 3/1915 | Hunter | 74/57 |
| 1,224,471 | 5/1917 | Kollock et al. | 72/452 |
| 1,763,500 | 6/1930 | Bowen | 30/392 |
| 3,072,003 | 1/1963 | Sirugue | 83/628 X |
| 3,111,053 | 11/1963 | Svensson | 83/543 X |
| 3,386,324 | 6/1968 | Ihle | 83/543 |
| 3,760,676 | 9/1973 | Daniels | 83/916 X |
| 4,638,731 | 1/1987 | Kato | 72/452 X |

*Primary Examiner*—Frank T. Yost
*Assistant Examiner*—Rinaldi Rada
*Attorney, Agent, or Firm*—Fleit, Jacobson, Cohn, Price, Holman & Stern

[57] ABSTRACT

A punching apparatus, preferably for punching intermittently moving webs of synthetic thermoplastics, comprises top and bottom tools, which are mounted in a machine frame and at least one of which is connected to a drive for moving said one tool up and down. The tools for making the punching cut consist of a knife plate or a knife ring and a backing plate or a backing ring and at the end of the punching cut strike against each other or almost contact each other.

13 Claims, 5 Drawing Sheets

PUNCHING APPARATUS

BACKGROUND OF THE INVENTION

1. Field of the Invention

This invention relates to a punching apparatus, preferably for punching intermittently moving webs made of synthetic thermoplastics, which apparatus comprises top and bottom tools, which are mounted in a machine frame and at least one of which is connected to a drive for moving said one tool up and down.

2. Description of the Prior Art

Punching apparatuses of various kinds are known in different embodiments. But they usually cut like shears so that the cooperating cutting edges of the top and bottom tools do not strike against each other but move one beside the other with a clearance so that the punching cut is effected into an unsupported portion of the material being punched.

SUMMARY OF THE INVENTION

It is an object of the invention to provide a punching apparatus which is of the kind described first hereinbefore and which is capable of making neat cuts.

In accordance with the invention that object is accomplished is a punching apparatus of the kind described first hereinbefore in that the tools for making the punching cut consist of a knife late or a knife ring and a backing plate or a backing ring and at the end of the punching cut strike against each other or almost contact each other. The punching apparatus in accordance with the invention comprises punching tools having hard surfaces striking against each other and the use of such apparatus will be particularly desirable and suitable when webs of thermoplastic material are to be punched, e.g., in the manufacture of bags or sacks.

In accordance with a further feature of the invention a carrier member of the movable tool assembly is provided with a guide for a connecting member used to move said movable die, and a hard-elastic and/or hard-plastic pad is provided for holding said connecting member against a stop, which when viewed in the direction in which it is driven is disposed at the rear end of the guide. During a punching cut in which hard parts strike against each other said pad ensures not only the required yieldability but will also act as a shock absorber so that the vibrational load on the apparatus will be decreased.

In numerous applications two punching apparatuses must be mounted one beside the other in the machine frame so that said two apparatuses will mutually independently perform punching cuts in a web, which is preferably intermittently conveyed. But two punching apparatuses which make punching cuts independently of each other will give rise to vibrations in the machine frame and said vibrations will adversely affect the respective other punching apparatus or other processing apparatus, such as welding means.

For this reason it is a further object of the invention to provide means for supporting and movably mounting two or more punching apparatuses in a machine frame in such a manner that they will not be adversely affected in operation by shock stresses produced by them. This means that mounting means are to be provided by which a plurality of mutually independently acting punching apparatuses are mounted in such a manner that shocks or vibrations will be decreased or damped by each mounting means.

This object is accomplished in a manner for which independent protection is claimed and which resides in that two punching apparatuses are provided in the machine frame, the top tools and the bottom tools, respectively, of said punching apparatuses are associated with each other and are respectively secured to two parallel frame plates, which are separate from each other, or to side bars carrying said frame plates, those of said frame plates which carry top tools and bottom tools, which are respectively associated with each other, are respectively interconnected by upper crossbeams, and all frame plates are fixedly interconnected at their lower ends. In that mounting arrangement in accordance with the invention the tools of each punching apparatus are movably mounted or supported on frame plates or on side bars which carry frame plates and said frame plates and/or side bars constitute independent sub-frames, which at their top ends are interconnected by beams and are jointly connected only at their bottom ends. Because the machine frame is thus composed of pairs of frame plates, which constitute parts of sub-frames, the shock and vibrational stresses are considerably reduced in a surprising manner. This may be due to the fact that the vibrations offset each other at the joint fixing means provided at the bottom, or this may be due to different reasons, which still have to be investigated. The frame plates of a given sub-frame may contact each other or may be spaced apart.

In a preferred arrangement, each pair of juxtaposed frame plates constitute an outer frame plate and an opposite inner frame plate, which constitute carrying plates for associated top and bottom tools. Owing to that staggered arrangement the distance between the frame plates for carrying a given punching apparatus will always be the same.

In accordance with a further feature of the invention, three or more punching apparatuses are provided, two parallel groups of frame plates are associated with each punching apparatus and the outer frame plate of one group and the inner frame plate of the other group and the succeeding ones constitute the sub-frames for mounting a punching apparatus.

The associated frame plates or side bars are suitably provided on their top and bottom sides with raised portions, which are consecutively arranged in the longitudinal direction, and the top and bottom tools are longitudinally slidably guided on and adapted to the fixed to the raised portions. Each sub-frame suitably comprises two parallel side bars for holding and guiding top and bottom tools, which are respectively associated with each other.

The top and bottom tools may be mounted on carriages which are slidable on and adapted to be fixed to the frame plates or the associated side bars.

The upper carriages may comprise laterally protruding arms, which by means of sliders and/or rollers are supported on the sliding surfaces which are constituted by the raised portions. The lower carriages may be supported by upper rollers or sliders carried only by upper arms and riding on the tracks which are constituted by the elevated portions in an arrangement in which the carriage is urged against the rails by a resilient cantilever arm, and a screw is provided for a longitudinal adjustment of the lower carriage. The resilient retaining arm may be secured to a lower crossbeam, by which the groups of left-hand and right-hand sub-frames or frame plates are interconnected. The adjusting screw can be used to effect a fine adjustment of the punching tools during operation if the punching cut is inaccurate.

The movable punching tool is usually moved up and down by a pneumatic piston-cylinder unit. But such piston-cylinder unit inherently cannot be used to provide a desired motion characteristic. For this reason it is a further object of the invention to provide a punching tool drive which will impart a desired motion to the moving punching tool.

That object is accomplished in accordance with the invention in that preferably the upper tool assembly is carried by a guide member that is axially slidably and non-rotatably guided in a slide bushing of a holder and is provided with a peripheral groove, which has side faces that constitute tracks for slide cams or slide rollers, which are secured to axles of a pressure-applying head, which is mounted in the frame to be rotatable about the axis of the guide member and is axially fixed and which ia connected to drive means for imparting a continuous rotation or a reciprocating motion to said head, and the tracks are so shaped that the pressure-applying head by its rotation or pivotal movement will impart the desired up end down motion to the guide member.

In that case the tracks may be so designed that the guide member will be operated with a motion characteristic which is optimally adapted to the desired cutting operation.

The pressure-applying head is desirably rotatably mounted on a pin, which is secured to a yokelike carrier of frame or the carriage and is formed with a central bore, in which a pinlike top extension of the guide member is axially slidably guided.

In accordance with a further feature of the invention, associated axles of the pressure-applying head include an angle of 90 degrees, with each other, cam follower rollers are coaxially mounted on mutually opposite axles, two of said cam follower rollers ride only on the lower track and two only on the upper track of the track groove, the lower side face is provided with mutually opposite raised portions, the upper side face is provided with mutually opposite, complementary recesses, and said raised portions and recesses are spaced 90 degrees apart. The raised portions and recesses can be so designed that the desired drive motion will be imparted to the guide member. That drive motion is preferably performed in such a manner that a higher acceleration is imparted at the beginning of the movement and the movement is performed only at a lower velocity toward its end so that the punching tools will strike against each other at a reduced velocity. Each roller bears on the upper or lower side face of the peripheral groove in such a manner that the rollers hold and guide the guide member substantially without a backlash in the axial direction.

The guide member is suitably provided around its periphery with axially extending multiple splines, which are guided in corresponding grooves of the guide bushing of the carriage.

The design cf the punching apparatus in accordance with the invention can similarly be adopted for twin presses, which differ from twin punching apparatuses merely in that cooperating press tools are provided rather than cooperating punching tools. For this reason, protection is also claimed for similarly designed twin presses, in which the punching tools have been replaced by compression molds consisting each of a punch and die.

DESCRIPTION OF THE PREFERRED EMBODIMENTS

Figure 1:
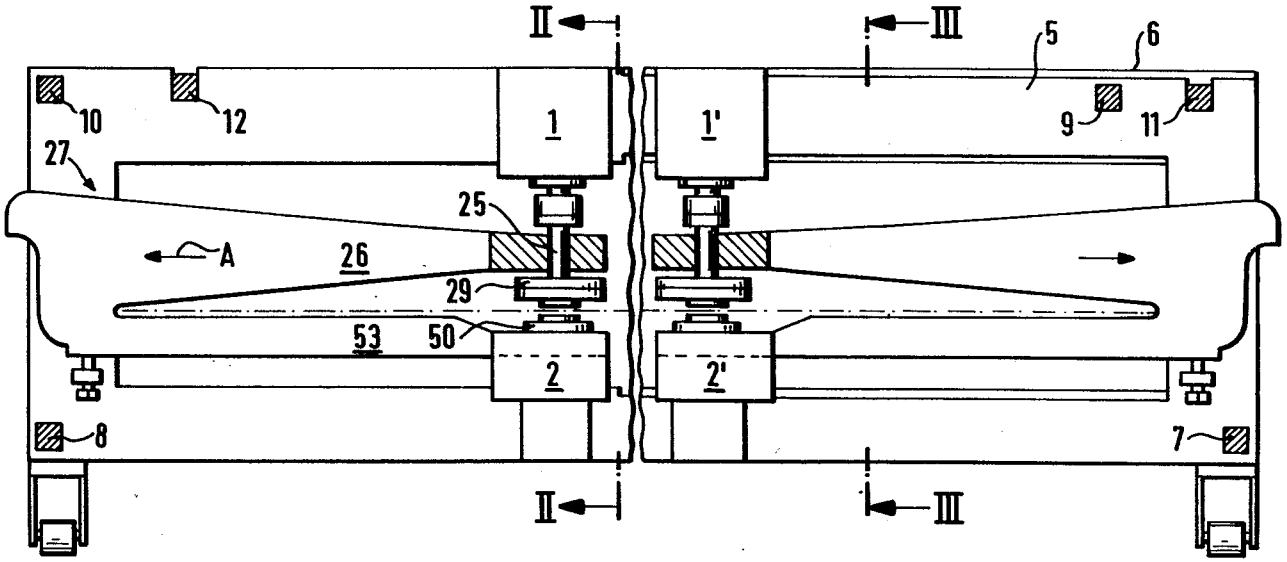
FIG. 1 is a side elevation showing a twin press, partly in section.

An illustrative embodiment of the invention will now be explained more in detail with reference to the drawing.

The apparatus which will be explained will be described hereinafter as a twin press even though the apparatus is used to make punching cuts. The term "twin press" has been adopted because the punches 29 and the dies 50 may consist of punching tools or of compression molds.

Figure 2:
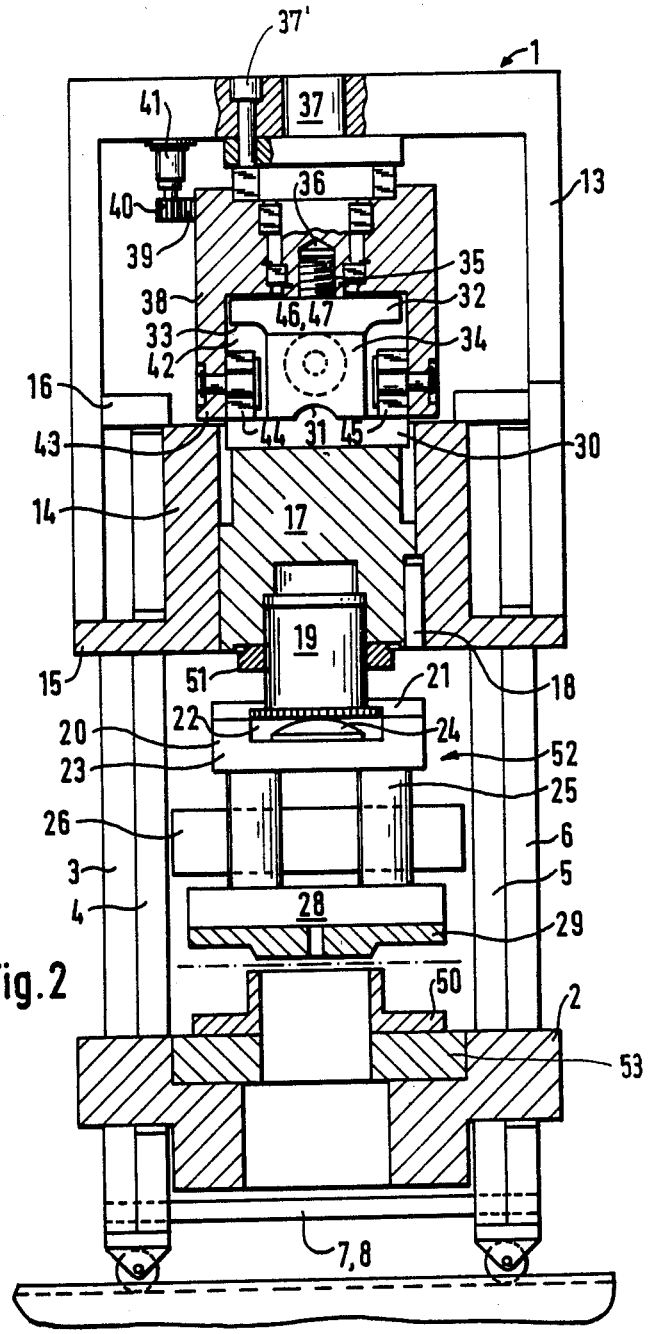
FIG. 2 is a sectional view taken on line II—II in FIG. 1 and showing the twin press.
Figure 3:
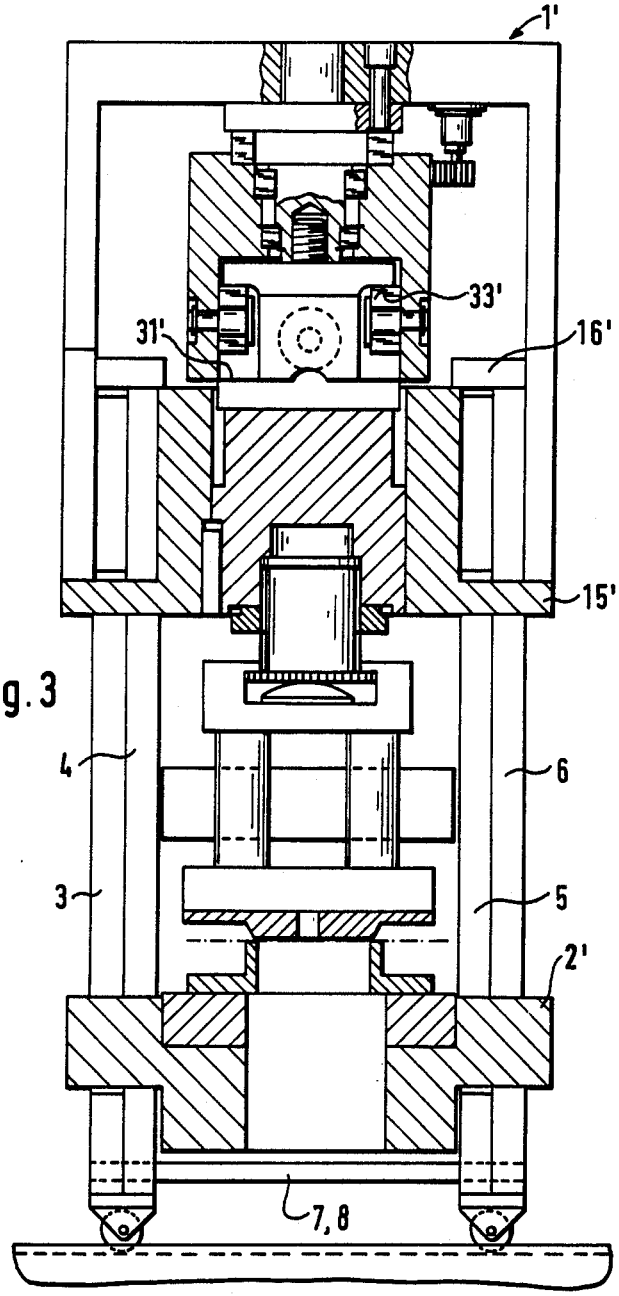
FIG. 3 is a sectional view taken on line III—III in FIG. 1 and showing the twin press.
Figure 5:
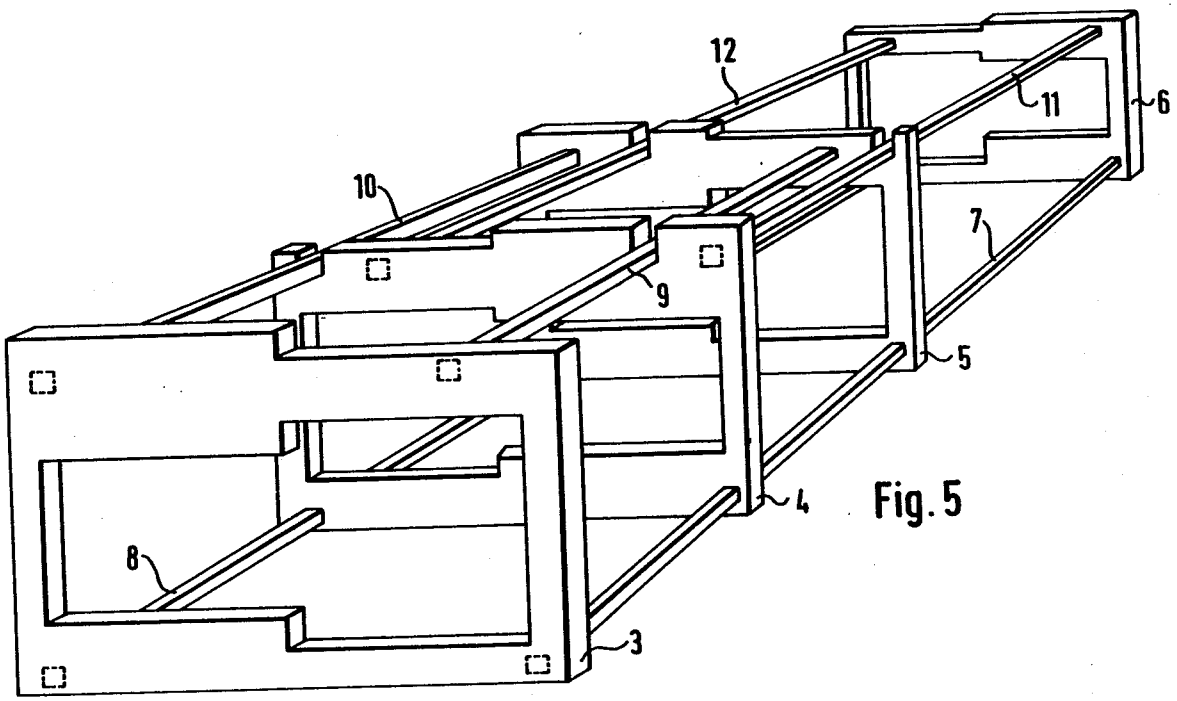
FIG. 5 shows the frame which carries the press in a perspective view, in which the frame parts are exploded for clearer representation.

In FIG. 1 the two top parts of the twin press are designated 1 and 1' and the two base parts of the press are designated 2 and 2'. The frames which carry said parts are apparent from FIG. 5 and are designated 3, 4, 5 and 6. It is apparent from FIGS. 2 and 3 that the frames 3 and 4 contact each other and so do the inner and outer frames 5 and 6. The frame parts 3 and 4, on the one hand, and 5 and 6, on the other hand, are shown spaced apart in FIG. 5 only for sake of a clear showing. The frames are fixedly interconnected in their bottom portion by bars 7 and 8, which are rectangular in cross-section. The top portions of the frames 3 and 5 are fixedly interconnected by bars 9 and 10. The top portions of the frames 4 and 6 are fixedly interconnected by bars 11 and 12. It is also apparent from FIG. 5 that the frames 3 and 5 are identical and so are the frames 4 and 6.

it is apparent from FIG. 2 that the base part 2 rests on the two frames 3 and 5 and, as is apparent from FIG. 3, the base part 2' rests on the frames 4 and 6. As a result, any loads which are applied to the base part 2 and resulting slight resilient defection of the two frame parts 3 and 5 cannot be transmitted to the base part 2' because the latter, as has been mentioned, rests on the frames 4, 6 rather than on the frames 3, 5. The top part 1 which is associated with the base part 2 consists of a frame 13, which by means of the cantilever arms 15 of the holder 14 and by clamping members 16 connected to the frame 13 is clamped to the top portions of the two frames 3 and 5. When the clamped joints have been loosened or released, the top part 1 can be displaced like a carriage on the associated side bars of the frame. The identical other top part 1' is analogously clamped to the upper portions of the two frames 4 and 6 by the cantilever arms 15' and the two clamping members 16'.

The holder 14 contains a guide member 17, which is slidably guided in the holder 14 by means of a key 18. A connecting member 19 is screwed from below into the guide member 17 and carries a depending extension 20, which is disposed behind a cover 21, which defines a cylindrical space 22 in a carrier 23. A hard rubber buffer 24 rests on the bottom of the cylindrical space 22 and at that end which faces away from the bottom of the cylindrical space bears on the extension 20.

Pins 25 are fixed to the carrier 23 and extend with a small clearance through an upper arm 26 of a toolholder that is generally designated 27. The pressure-applying plate 28, which carries the punch 29, is provided at the bottom end of the pins 25.

The guide member 17 is fixed to a cover 30, which is provided with an internal cam track 31. Another cover 32 is provided, which is spaced from the cover 30 and is also provided with an internal cam track 33. The two covers 30 and 32 are fixed to each other by a member 34, which has been turned on a lathe. The control assembly which is constituted by the two covers 30 and 32 and the lathe-turned member 34 is provided with an upstanding pin 35, which is movably mounted in a bore 36 of a retaining pin 37, which is fixedly secured by a screw 37' into the frame 13.

Figure 4:
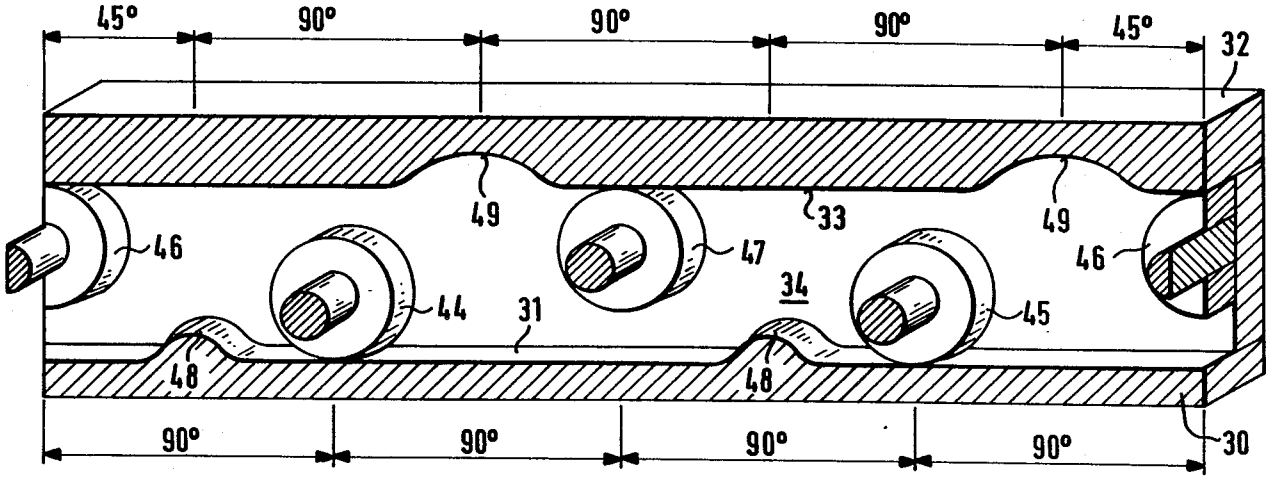
FIG. 4 is a longitudinal sectional view showing the development of the cam portion for controlling the stroke of the press.

A pressure-applying head 38 is rotatably mounted on the retaining pin 37. A gear segment 39 is screw-connected to the head 38 and meshes with a pinion 40 of a gearmotor 41 so that the latter is operable to rotate the pressure-applying head. The pressure-applying head 38 has at its bottom a recess 42, which has been turned with a lathe and which receives the control assembly that consists of the covers 30 and 32 and the member 34. Four rollers 44, 45, 46 and 47 are rotatably mounted in the annular wall 43 of the pressure-applying head 38. The rollers 44 and 45 are disposed opposite to each other in a plane. The rollers 46 and 47 are disposed opposite to each other in a somewhat more elevated plane. This will be apparent from FIG. 4, in which the member 34 and the lower and upper cam tracks as well as the covers 30 and 32 are shown in developed views. During an operation of the motor 41 the pressure-applying head 38 will rotate in unison with the rollers 44 to 47, which ride on the tracks 31 to 33. As soon as the rollers 44 and 45 reach the raised portions 48 and the upper rollers 46 and 47 reach the recesses 49 the punch 29 will be forced down against the die 50 to an extent which depends on the height of the raised portions by a movement which is transmitted by the guide member 17, the connecting member 19, the hard rubber plate 24, the carrier 23, the pin 25 and the pressure-applying plate 28. As a result, the film lying between the punch 29 and the die 50 will be punched by parts striking hard against each other.

An exact adjustment is effected in that the connecting member 19 is screwed into the guide member 17 to a larger or smaller depth and is fixed in its adjusted position by the clamp ring 51. It is apparent from FIGS. 1 and 2 that the punch 29 is mounted by the pins 25 in the upper arm 26 of the toolholder 27 and the die 50 is mounted in the lower arm 53 of the toolholder 27. As the toolholder 27 is laterally movable out of the press in the direction of the arrow A, another toolholder carrying another set of tools can be inserted in a simple manner. The press shown in FIG. 3 has the same design as the press which has previously been described with reference to FIG. 2 so that a more detailed description of the present illustrative embodiment is not required. It is merely pointed out that the cam tracks 31' and 33', which correspond to the internal cam tracks 31 and 33, are shown after their rotation to a position in which the punching apparatus is in its closed position whereas the punching apparatus is shown in its open position in FIG. 2.

The right-hand side of FIG. 1 corresponds to the left-hand side so that further explanations are not required.

Upon a comparison of FIGS. 2 and 3 it is apparent that the base part 2 and the top part 1 are supported on the frames 3 and 4 and the base part 2' and the top part 1' in FIG. 3 are supported by the frames 4 and 6. That separate support is necessary because a so-called "hard-on-hard" press must be operated with a very exact adjustment and the two presses must not disturb each other, as would be the case, e.g., if the two presses were mounted on a common frame so that any resilient deflections adjacent to one press would inevitably result in a slight change of the position of the other press.

We claim:

1. An apparatus particularly suited for intermittently punching moving webs made of synthetic thermoplastics, which apparatus comprises top and bottom tools, which are mounted in a machine frame and at least one of which is connected to a drive for moving said one tool up and down, wherein two punching apparatuses are provided in the machine frame, each of the punching apparatuses includes one of the top tools and one of the bottom tools, respectively, the top tool and the bottom tool of each of said punching apparatuses are secured to a respective pair of parallel frame plates, which are separate from each other and which have upper and lower ends, said frame plates of each pair of frame plates are interconnected adjacent their upper ends by upper bars, with the upper bars for each pair of frame plates being separate from the upper bars for the other pair of frame plates, and all of said frame plates are fixedly interconnected adjacent their lower ends, thereby supporting said punching apparatuses from separate frame plates.

2. A punching apparatus according to claim 1, wherein each pair of frame plates constitutes an outer frame plate and an opposite inner frame plate, which constitute carrying plates for associated ones of the top and bottom tools, with the outer frame plate of each pair of frame plates being in juxtaposed relationship to the inner frame plate of the other pair of frame plates.

3. A punching apparatus according to claim 1, wherein the frame plates of each pair of frame plates are provided adjacent their upper and lower ends with wider portions, which are consecutively arranged in a longitudinal direction, and the top and bottom tools are fixed to said wider portions.

4. A punching apparatus according to claim 3, wherein the top tools comprise laterally protruding arms which bear from below on sliding surfaces of the wider portions of the frame plates.

5. A punching apparatus according to claim 3, wherein the bottom tools bear from above on rails which are constituted by the wider portions.

6. A punching apparatus according to claim 1, wherein each pair of frame plates comprises parts of a sub-frame which further comprises the upper bars, the bars being in the form of two parallel side bars, and the sub-frame further comprises lower side bars, the side bars being for holding and guiding respective ones of the top and bottom tools.

7. A punching apparatus according to claim 6, wherein the top and bottom tools are mounted on carriages, which are slidable on and adapted to be fixed to respective ones of the sub-frames.

8. A punching apparatus according to claim 1, wherein the top tool is carried by a guide member that is axially slidably and non-rotatably guided in a slide bushing of a holder and is provided with a peripheral groove, which has side faces that constitute tracks for slide rollers, which are secured to axles of a pressure-applying head, which is mounted in the frame to be rotatable about the axis of the guide member and is axially fixed and which is connected to drive means for imparting rotation to said head, and the tracks are so shaped that the pressure-applying head by its rotation will impart the desired up and down motion to the guide member.

9. A punching apparatus according to claim 8, wherein the pressure-applying head is rotatably mounted on a pin, which is secured to the frame and said pin has a central bore, in which a pinlike top extension of the guide member is axially slidably guided.

10. A punching apparatus according to claim 8, wherein axles of the pressure-applying head are disposed at an angle of 90 degrees with each other, cam follower rollers are coaxially mounted on mutually opposite axles, two of said cam follower rollers ride only on the lower track and two only on the upper track of the track groove, the lower side face is provided with mutually opposite raised portions, the upper side face is provided with mutually opposite, complementary recesses, the said raised portions and recesses are spaced 90 degrees apart.

11. A punching apparatus, preferably for punching intermittently moving webs made of synthetic thermoplastics, which apparatus comprises top and bottom tools, which are mounted in a machine frame and at least one of which is connected to a drive for moving said one tool up and down, wherein two punching apparatuses are provided in the machine frame, each of the punching apparatuses includes one of the top tools and one of the bottom tools, respectively, the top and bottom tool of each of said punching apparatuses are secured to sub-frames each comprising two parallel frame plates, which are separate from each other, said frame plates of each of said sub-frames are respectively interconnected adjacent their upper ends by upper bars, with the upper bars of each sub-frame being separate from the upper bars of the other sub-frame, and all of said frame plates are fixedly interconnected at their lower ends, thereby supporting said punching apparatuses on separate sub-frames.

12. An apparatus for punching a workpiece comprising a supporting frame, a pair of punching apparatuses, means for mounting said punching apparatuses on said frame, each punching apparatus comprising an upper tool and a lower tool oriented in opposed relation for contact with the workpiece, means driving said upper tools to move an upper tool toward and away from a respective one of said lower tools, said frame including a plurality of pairs of independent frame plates having top portions and bottom portions, top bars connecting the top portions of one pair of said frame plates, separate top bars connecting the top portions of a second pair of said frame plates, and bottom bars connecting the bottom portions of all of said frame plates, thereby supporting said punching apparatuses from separate frame plates.

13. The apparatus as defined in claim 12 wherein each punching apparatus includes a tool holder having an upper arm and a lower arm, said lower tool including a die supported by said lower arm and said frame, said upper tool including a punch, said upper arm including means retaining said punch in alignment with said die during movement of the punch toward and away from the die, said means driving said upper tools including a holder supported from said frame, a guide member movably mounted on said holder and connected with the punch, a rotatable pressure head mounted on said frame, drive means rotating said pressure head and a cam track and roller type cam followers interconnecting said pressure head and guide member to cause reciprocation of the guide member and punch connected thereto in response to rotation of the pressure head.

* * * * *